US010448496B2

(12) United States Patent
Kazakov

(10) Patent No.: US 10,448,496 B2
(45) Date of Patent: Oct. 15, 2019

(54) SUPERCONDUCTING CAVITY COUPLER

(71) Applicant: Fermi Research Alliance, LLC, Batavia, IL (US)

(72) Inventor: Sergey Kazakov, Batavia, IL (US)

(73) Assignee: Fermi Research Alliance, LLC, Batavia, IL (US)

( * ) Notice: Subject to any disclaimer, the term of this patent is extended or adjusted under 35 U.S.C. 154(b) by 324 days.

(21) Appl. No.: 15/278,299

(22) Filed: Sep. 28, 2016

(65) Prior Publication Data

US 2017/0093012 A1 Mar. 30, 2017

Related U.S. Application Data

(60) Provisional application No. 62/233,878, filed on Sep. 28, 2015.

(51) Int. Cl.

| | |
|---|---|
| ***H05H 7/20*** | (2006.01) |
| ***H01P 5/103*** | (2006.01) |
| *H01P 7/06* | (2006.01) |

(52) U.S. Cl.

CPC ..... *H05H 7/20* (2013.01); *H01P 5/103* (2013.01); *H01P 7/06* (2013.01)

(58) Field of Classification Search

CPC ..... H05H 7/20; H01P 5/103; H01P 7/06
See application file for complete search history.

(56) References Cited

U.S. PATENT DOCUMENTS

| | | | | |
|---|---|---|---|---|
| 3,927,369 | A * | 12/1975 | Billeter | G01K 5/52 324/636 |
| 4,002,943 | A * | 1/1977 | Regan | H01J 19/80 315/248 |
| 4,287,496 | A * | 9/1981 | Young | H01P 5/103 333/248 |
| 8,674,630 | B1 | 3/2014 | Cornelius | |
| 8,779,697 | B2 | 7/2014 | Baurichter et al. | |
| 9,398,681 | B2 | 7/2016 | Tantawi et al. | |
| 2008/0068112 | A1 | 3/2008 | Yu et al. | |
| 2011/0036101 | A1* | 2/2011 | Tigwell | H01F 6/02 62/48.1 |
| 2012/0138340 | A1* | 6/2012 | Kato | H05K 1/028 174/251 |

* cited by examiner

*Primary Examiner* — Paul A Wartalowicz
(74) *Attorney, Agent, or Firm* — Kevin Soules; Kermit D. Lopez; Luis M. Ortiz

(57) ABSTRACT

A cavity coupler comprising of an outer coupler body, at least one shield formed inside the outer coupler body wherein the relationship between the shield and the outer coupler body form at least one chamber, an antenna configured to provide a radio frequency signal, and a flange for connecting the cavity coupler to a superconducting cavity. In an embodiment, the outer coupler body is formed of stainless steel. In an embodiment, the at least one shield is formed of copper.

14 Claims, 2 Drawing Sheets

SUPERCONDUCTING CAVITY COUPLER

CROSS REFERENCE TO RELATED PATENT APPLICATIONS

This patent application claims the priority and benefit under 35 U.S.C. § 119(e) of U.S. Provisional Patent Application Ser. No. 62/233,878 filed Sep. 28, 2015, entitled "SUPERCONDUCTING CAVITY COUPLER." U.S. Provisional Patent Application Ser. No. 62/233,878 is herein incorporated by reference in its entirety.

STATEMENT OF GOVERNMENT RIGHTS

The invention described in this patent application was made with Government support under the Fermi Research Alliance, LLC, Contract Number DE-AC02-07CH11359 awarded by the U.S. Department of Energy. The Government has certain rights in the invention.

TECHNICAL FIELD

Embodiments are generally related to the field of superconducting cavities. Embodiments are further related to a main coupler for radiofrequency (RF) superconducting cavities.

BACKGROUND

A superconducting cavity coupler's function is to deliver RF power from the outside RF power source with minimal resistive losses to the superconducting cavity. At the same time, the coupler isolates the cavity vacuum from the outside environment and minimizes heat flow from the surroundings to the cryogenic temperature cavity. To prevent heat flow, the outer conductor of a coupler is made of stainless steel because of its low thermal conductivity. To decrease ohmic losses, the stainless steel is coated with a thin layer of copper. This coating is generally applied to the stainless steel using a galvanic or plasma-based process.

This approach has several drawbacks. First, the technology used to plate copper is not sufficiently developed to provide a reliable reproducible coating. For example, the copper coating often flakes or peels away from the stainless steel. Copper flaking is fatal for the superconducting cavity. In addition, the copper layer increases the thermal conductivity of the stainless steel outer conductor and increases the heat flow to the cavity. As a result, the cavity requires a more powerful cryo-plant to compensate, which reduces the efficiency of the system. Finally, the copper layer has a low residual-resistance ratio (RRR). It increases ohmic losses, deposits additional heat into the superconducting cavity, and reduces system efficiency.

An additional difficulty arises in protecting the ceramic surface of the dielectric RF window from charged particles emanating from the superconducting cavity. In the prior art, some waveguide couplers use a bent waveguide to remove the dielectric surface from line of sight of the superconducting cavity. This provides the dielectric surface with some protection from charged particles. However, this approach is not useable in a coaxial coupler.

Accordingly, methods and systems are required for superconducting cavity couplers that avoid these disadvantages.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for superconducting cavities.

It is another aspect of the disclosed embodiments to provide a method and system for superconducting cavity couplers.

It is another aspect of the disclosed embodiments to provide methods, systems, and apparatuses for main couplers for superconducting radiofrequency cavities.

The aforementioned aspects and other objectives and advantages can now be achieved as described herein. Systems and methods for a cavity coupler comprise an outer coupler body, at least one shield formed inside the outer coupler body wherein the relationship between the shield and the outer coupler body form at least one chamber, an antenna configured to provide a radio frequency signal, and a flange for connecting the cavity coupler to a superconducting cavity. In an embodiment, the outer coupler body is formed of stainless steel. In an embodiment, the at least one shield is formed of copper.

The at least one shield may comprise three or more shields. The three shields further comprise a first shield connected to a first end of the outer body, a second shield connected to a thermal intercept, wherein a first end of the second shield overlaps a second end of the first shield, and a third shield connected to a second end of the outer body, wherein a first end of the third shield overlaps a second end of the second shield.

In an embodiment, the cavity coupler further comprises a first disk and a second disk, wherein the first disk and the second disk overlap in order to prevent a line of sight through the cavity coupler to an RF window.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment, and the phrase "in another embodiment" as used herein does not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 1:
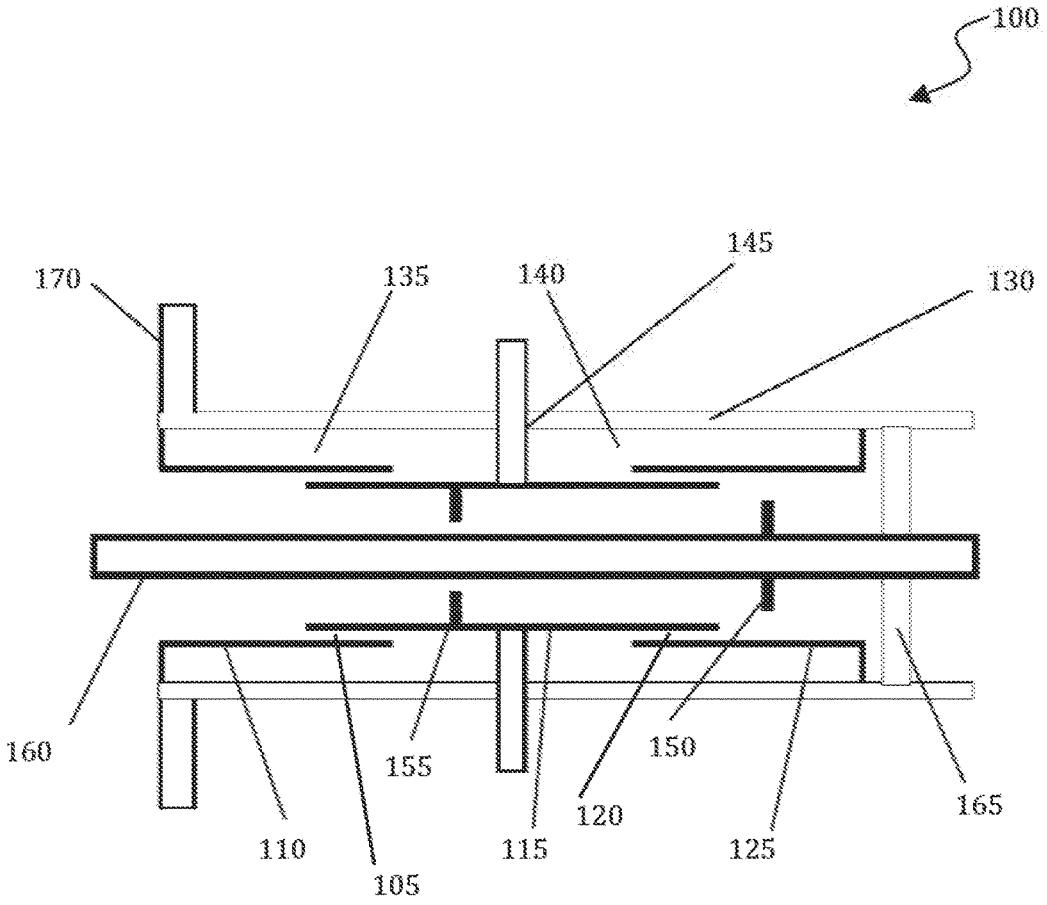
FIG. 1 depicts a super conducting cavity coupler in accordance with an exemplary embodiment and FIG. 2 depicts a method for coupling a cavity is a source accordance with an exemplary embodiment.

FIG. 1 illustrates an exemplary embodiment of a superconducting cavity coupler 100. Superconducting cavity coupler provides a coupling between a superconducting cavity and an external radio frequency source. Superconducting cavity coupler 100 is coupled to a superconducting cavity with a flange 170. The cavity coupler 100 uses at least one, and potentially many shields to facilitate the transmission of RF power from an outside power source to a superconducting cavity efficiently. In certain embodiments, the super conducting cavity coupler may comprise a coaxial cavity coupler.

In a preferred embodiment one or more shields, such as shield 110, shield 115, and shield 125, are formed on the inside of the cavity coupler. The shields are formed of a material that has good electrical conductivity, such as copper. In other embodiments, the shields may be composed of any highly conductive material. The copper shields are preferably formed of solid copper. Solid copper shields do not flake and therefore eliminate the danger of fouling the superconducting cavity associated with prior art approaches.

The shields in the superconducting cavity coupler 100 create two chambers, chamber 135 and chamber 140, separated by thermal intercept 145. The chambers 135 and 140 are defined by the shielding created by the shields and therefore have very low electromagnetic fields. As a result, losses, even in the uncoated stainless steel body, are negligible. The majority of the RF current flows on copper shields. Since the copper shields are made of solid copper, the RRR is very high and ohmic losses are smaller than prior art methods using copper plated on the interior walls of the cavity.

In an embodiment, a slot 105 is formed between shield 110 and shield 115 and another slot 120 between shield 115 and shield 125. Slot 105 and slot 120 prevent heat flow through the copper shield 110, copper shield 115, and shield 125. All of the heat flow travels through the outer conductor 130. Outer conductor 130 is formed from a low thermal conductivity material such as stainless steel tube. Other low thermal conductivity materials may alternatively be used. The outer conductor 130 provides better thermal isolation of superconducting cavity coupler 100 from the surrounding room temperature environment.

Shield 110 is configured to at least partially overlap shield 115, and shield 115 is similarly configured to at least partially overlap shield 125. In the embodiment shown, shield 110, shield 115, and shield 125 have a substantially cylindrical configuration. In the embodiment shown, shield 110 and shield 125 connect to first and second ends, respectively, of the outer conductor 130, while shield 115 attaches midway between the first and second ends of the outer conductor 130 to thermal intercept 145. The connection between the shields and the outer conductor can be achieved via welding, brazing, screws, bolts, rivets, or other such connecting means provided the connection provides sturdy mechanical contact and good electrical contact.

The spatial configuration of the shields is critical. The configuration of the shields significantly reduces the electromagnetic fields at the surface of the outer conductor 130. However, the shields do not increase the thermal conductivity of the outer conductor. In an embodiment, the shields do not have thermal or mechanical contact between each other. As a result, superconducting cavity coupler 100 takes advantage of the thermal conductivity of the outer conductor for thermal isolation and the electrical conductivity of the shield material to entrain the RF current flow. This allows superconducting cavity coupler 100 to have a low thermal conductivity and simultaneously high electrical conductivity.

At one end of the chamber a dielectric RF window 165, commonly comprising a ceramic material, is formed which separates the vacuum drawn on the coupler side of the RF window 165 and the external atmosphere on the right side of the RF window 165. The RF window 165 must remain transparent to electromagnetic waves while preserving the desired vacuum. The possible flow of charged particles from the superconducting cavity to the ceramic window may damage the RF window 165.

The superconducting cavity coupler 100 can therefore include disk 150 and disk 155. Disk 150 and disk 155 surround the RF antenna 160. Disk 150 can be formed on and/or substantially around antenna 160. Disk 155 can be formed on shield 115. The disks may be formed to be substantially flat and circular. However, the disks may be formed in other shapes provided that disk 155 at least partially overlaps disk 150. The overlapping of disk 150 and disk 155 eliminates line of sight between the output coupler and the ceramic surface of the dielectric RF window 165. Disk 150 and disk 155 effectively hide the dielectric surface of the dielectric RF window 165 from charged particles that can come from the superconducting cavity. In an embodiment, disk 155 can be kept at a low temperature (e.g., approximately that of liquid nitrogen). This significantly decreases thermal radiation propagating from the room temperature dielectric RF window 165 towards the superconducting cavity.

Disk 150 and disk 155 collect charged particles (e.g., electrons) without accumulating a charge. Accordingly, the disks must be made of metal. Moreover, to reduce ohmic losses and improve the parameters of the superconducting cavity coupler 100, the metal should have good electrical conductivity. In one embodiment, disk 150 and disk 155 can be formed of copper.

It should be appreciated that in certain embodiments of superconducting cavity coupler 100 both the shields and the disks may be present, while other embodiments may use only the disks or only the shields.

Figure 2:
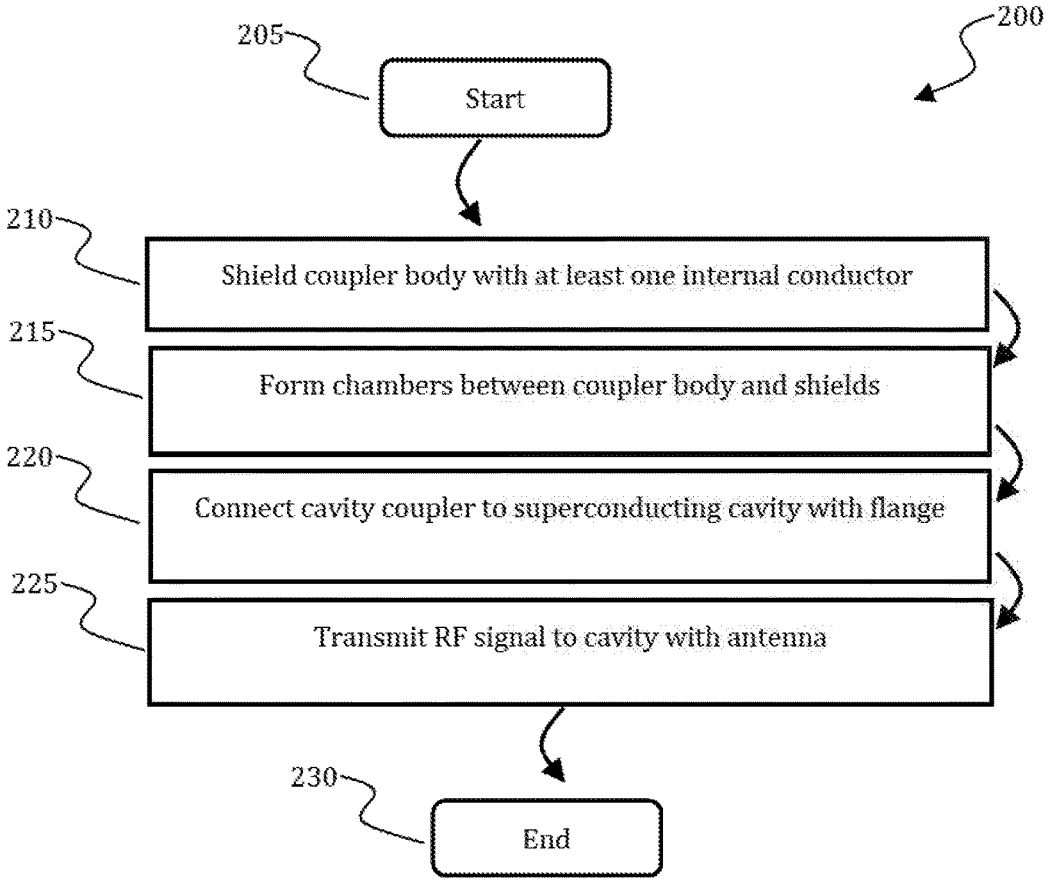

FIG. 2 illustrates a flow chart associated with a method 200 for coupling a cavity to a radio frequency source according to the disclosed embodiments. The method begins at step 205. A step 210, an outer coupler body can be shielded with at least one internal shield. The relationship between the shields and the coupler body can form chambers at step 215. The cavity coupler can be connected to a superconducting cavity with a flange as illustrated at step 220. At step 225, a radio frequency signal can be transmitted to the superconducting cavity with an antenna running though the body of the coupler cavity. The method then ends at step 230.

Based on the foregoing, it can be appreciated that a number of embodiments, preferred and alternative, are disclosed herein. For example, in one embodiment, a cavity coupler comprises an outer coupler body, at least one shield formed inside the outer coupler body wherein the relationship between the shield and the outer coupler body form at least one chamber, an antenna configured to provide a radio frequency signal, and a flange for connecting the cavity coupler to a superconducting cavity.

In an embodiment, the outer couple body is formed of stainless steel. In an, embodiment, the at least one shield is formed of copper.

In another embodiment, the at least one shield comprises three shields. The three shields further comprise a first shield connected to a first end of the outer body, a second shield connected to a thermal intercept, wherein a first end of the second shield overlaps a second end of the first shield, and a third shield connected to a second end of the outer body, wherein a first end of the third shield overlaps a second end of the second shield.

In another embodiment, the cavity coupler further comprises a first disk and a second disk, wherein the first disk and the second disk overlap in order to prevent a line of sight through the cavity coupler to an RF window.

In an embodiment, the cavity coupler comprises a coaxial cavity coupler.

In another embodiment, a system for coupling a cavity to a source comprises an outer coupler body, at least one shield formed inside the outer coupler body wherein the relationship between the shield and the outer coupler body form at least one chamber, an antenna configured to provide a radio frequency signal, and a flange for connecting the cavity coupler to a superconducting cavity.

In an embodiment of the system, the outer coupler body is formed of stainless steel. In an embodiment of the system, the at least one shield is formed of copper.

In an embodiment of the system, the at least one shield comprises three shields. The three shields further comprise a first shield connected to a first end of the outer body, a second shield connected to a thermal intercept, wherein a first end of the second shield overlaps a second end of the first shield, and a third shield connected to a second end of the outer body, wherein a first end of the third shield overlaps a second end of the second shield.

In an embodiment, the system further comprises a first disk and a second disk, wherein the first disk and the second disk overlap in order to prevent a line of sight through the cavity coupler to an RF window.

In an embodiment of the system, the cavity coupler comprises a coaxial cavity coupler.

In yet another embodiment, a method for coupling a cavity to a source comprises shielding an outer coupler body with at least one shield, forming at least one chamber with a relationship between the shield and the outer coupler body, connecting the cavity coupler to a superconducting cavity with a flange, and providing a radio frequency signal to a cavity with an antenna within the coupler body.

In an embodiment, the method further comprises forming the outer coupler body of stainless steel. In an embodiment, the method further comprises forming the at least one shield of copper.

In an embodiment, the at least one shield comprises three shields.

In an embodiment, the method further comprises connecting a first shield to a first end of the outer body, connecting a second shield to a thermal intercept, wherein a first end of the second shield overlaps a second end of the first shield, and connecting a third shield to a second end of the outer body, wherein a first end of the third shield overlaps a second end of the second shield.

In an embodiment, the method further comprises overlapping a first disk and a second disk, in order to prevent a line of sight through the cavity coupler to an RF window.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A cavity coupler comprising:

an outer coupler body;

at least one shield formed inside said outer coupler body, wherein the at least one shield is isolated from the outer coupler body, and wherein the relationship between the at least one shield and the outer coupler body form at least two chambers;

an antenna configured to provide a radio frequency signal; and a flange for connecting said cavity coupler to a superconducting cavity.

2. The cavity coupler of claim 1 wherein said at least one shield comprises three shields.

3. The cavity coupler of claim 2 wherein said three shields overlap.

4. The cavity coupler of claim 3 wherein said three shields further comprise:

a first shield connected to a first end of said outer body;

a second shield connected to a thermal intercept, wherein a first end of said second shield overlaps a second end of said first shield; and a third shield connected to a second end of said outer body, wherein a first end of said third shield overlaps a second end of said second shield.

5. The cavity coupler of claim 1 wherein the at least one shield is formed of solid copper.

6. The cavity coupler of claim 1 further comprising:

a first disk; and a second disk, wherein said first disk and said second disk overlap in order to prevent a line of sight through said cavity coupler to an RF window.

7. The cavity coupler of claim 1 wherein the cavity coupler comprises a coaxial cavity coupler.

8. A system for coupling a cavity to a source, said system comprising:

an outer coupler body;

at least one shield formed inside said outer coupler body, wherein the at least one shield is isolated from the outer coupler body, and wherein the relationship between the at least one shield and the outer coupler body form at least two chambers;

an antenna configured to provide a radio frequency signal; and a flange for connecting said cavity coupler to a superconducting cavity.

9. The system of claim 8 wherein said at least one shield comprises three shields.

10. The system of claim 9 wherein said three shields overlap.

11. The system of claim 10 wherein said three shields further comprise:

a first shield connected to a first end of said outer body;

a second shield connected to a thermal intercept, wherein a first end of said second shield overlaps a second end of said first shield; and a third shield connected to a second end of said outer body, wherein a first end of said third shield overlaps a second end of said second shield.

12. The system of claim 8 wherein the at least one shield is formed of solid copper.

13. The system of claim 8 further comprising:

a first disk; and a second disk, wherein said first disk and said second disk overlap in order to prevent a line of sight through said cavity coupler to an RF window.

14. The system of claim 8 wherein the cavity coupler comprises a coaxial cavity coupler.

* * * * *